US008314716B2

(12) United States Patent
Cook et al.

(10) Patent No.: US 8,314,716 B2
(45) Date of Patent: Nov. 20, 2012

(54) USE OF OLED TECHNOLOGY IN HVAC SENSORS

(75) Inventors: Matthew D. Cook, Antioch, IL (US); Pankaj Kalore, Chicago, IL (US); Wesley Disselkoen, Chicago, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 364 days.

(21) Appl. No.: 12/412,791

(22) Filed: Mar. 27, 2009

(65) Prior Publication Data

US 2009/0251329 A1 Oct. 8, 2009

Related U.S. Application Data

(60) Provisional application No. 61/039,861, filed on Mar. 27, 2008.

(51) Int. Cl.
*G08B 5/22* (2006.01)
*G09F 9/33* (2006.01)

(52) U.S. Cl. ..... 340/815.45; 340/584; 340/521; 340/531; 340/524

(58) Field of Classification Search ..... 340/584, 340/521, 531, 585, 533, 632, 524; 374/101, 374/110, 116, 141, 149; 62/331, 426; 236/44 C, 236/49.3, 91 D, 94

See application file for complete search history.

(56) References Cited

U.S. PATENT DOCUMENTS

| | | | | |
|---|---|---|---|---|
| 5,838,243 | A * | 11/1998 | Gallo | 340/632 |
| 6,215,405 | B1 * | 4/2001 | Handley et al. | 340/584 |
| 6,484,951 | B1 * | 11/2002 | Mueller | 237/2 A |
| 2004/0113883 | A1 * | 6/2004 | Kim et al. | 345/102 |
| 2005/0285842 | A1 * | 12/2005 | Kang et al. | 345/103 |
| 2006/0066452 | A1 * | 3/2006 | Chapman et al. | 340/632 |
| 2006/0154596 | A1 * | 7/2006 | Meneely, Jr. | 454/256 |
| 2006/0185382 | A1 * | 8/2006 | Kim et al. | 62/331 |
| 2006/0208630 | A1 * | 9/2006 | Roman et al. | 313/503 |
| 2007/0114291 | A1 * | 5/2007 | Pouchak | 236/44 C |
| 2007/0139183 | A1 * | 6/2007 | Kates | 340/521 |
| 2007/0241203 | A1 * | 10/2007 | Wagner et al. | 236/1 C |
| 2008/0237217 | A1 * | 10/2008 | Helt | 219/485 |
| 2008/0238712 | A1 * | 10/2008 | Thurmond et al. | 340/870.02 |
| 2008/0246388 | A1 * | 10/2008 | Cheon et al. | 313/501 |
| 2008/0246830 | A1 * | 10/2008 | Martin et al. | 348/14.02 |
| 2008/0316309 | A1 * | 12/2008 | Roper | 348/143 |
| 2009/0051760 | A1 * | 2/2009 | Ottney | 348/53 |
| 2009/0207122 | A1 * | 8/2009 | Cheng et al. | 345/102 |
| 2009/0291749 | A1 * | 11/2009 | Durham et al. | 463/25 |

* cited by examiner

*Primary Examiner* — Hoi Lau

(57) ABSTRACT

An organic light emitting diode (OLED) display panel for a heating ventilation and air conditioning (HVAC) sensor used for building automation controls. The OLED display will transmit information to the building occupant relating to heating ventilation and air conditioning outputs.

20 Claims, 3 Drawing Sheets

USE OF OLED TECHNOLOGY IN HVAC SENSORS

CROSS REFERENCE OF RELATED APPLICATIONS

This patent claims the priority benefit under 35 U.S.C. §119(e) of U.S. provisional patent application Ser. No. 61/039,861 (2008P05641US), submitted on Mar. 27, 2008; the content of which is hereby incorporated by reference for all purposes.

FIELD OF INVENTION

The invention relates to HVAC systems and, more particularly, organic light emitting diode (OLED) displays for HVAC sensors.

BACKGROUND

In building automation technology, a large percentage of heating ventilation air conditioning (HVAC) sensors have displays to indicate status information. Such status information is generally transmitted to the display, such as a signal indicating that the battery powering a thermostat is near the end of its useful life and needs to be replaced. Similarly, a thermostat unit itself may have a visual indictor, such as a light or LCD display, for displaying the actual temperature, the desired temperature, and the battery condition. These displays have traditionally used liquid crystal display (LCD) technology as other display technologies have been too expensive, until recently.

Displays on conventional HVAC sensors are often difficult to read because of low resolution and low contrast ratios. Some conventional displays or keypads offer only very limited feedback in the form of light emitting diodes (LEDs). Alternatively, some HVAC sensors utilize more flexible and customizable liquid crystal display (LCD) panels. However, LCD panels are expensive to manufacture and typically have a contrast ratio of only about 80. In addition, most LCDs have an off-axis viewing angle limitation of about 45 degrees or less. Additionally, LCD displays are reflective and may only be viewed when sufficient lighting is on them. It should also be noted that LCD displays may be back lit to make them more visible, but due to the nature of LCD's backlighting, the contrast is reduced, making it harder to see. Lastly, the backlighting of an LCD consumes large amounts of power and HVAC sensors are always sensitive to how much power is dissipated under the sensor housing.

Therefore there is a need for improvement in HVAC sensors and in particular the display panels for the HVAC sensor.

SUMMARY

It is one objective of the invention to provide, a building control sensor system comprising, a microcontroller; a sensing element coupled to the microcontroller; a OLED display coupled to the microcontroller; a set of cursor buttons coupled to the microcontroller; a testing service port coupled to the microcontroller; a wireless communication coupled to the microcontroller; a wired communication coupled to the microcontroller; and a power supply.

It is another objective of the invention to provide, a display for a building control sensor system, comprising: an OLED display coupled to a microcontroller.

It is another object of the invention to provide, a method to display information for a building control system, the steps comprising: providing a microcontroller; providing a sensing element coupled to the microcontroller; providing an OLED display coupled to the microcontroller; providing a set of cursor buttons coupled to the microcontroller; providing a testing service port coupled to the microcontroller; providing a wireless communication coupled to the microcontroller; providing a wired communication coupled to the microcontroller; and providing a power supply.

It is another object of the invention to provide, a method to display information for a building control system, the steps comprising: powering up a building controller with a power supply; coupling a sensor element to an OLED display; initiating a request for a system information; transmitting the system information from the building controller to the microcontroller; processing the system information by microcontroller; transmitting an output to the OLED display; and displaying the output on the OLED display.

DETAILED DESCRIPTION

Figure 1:
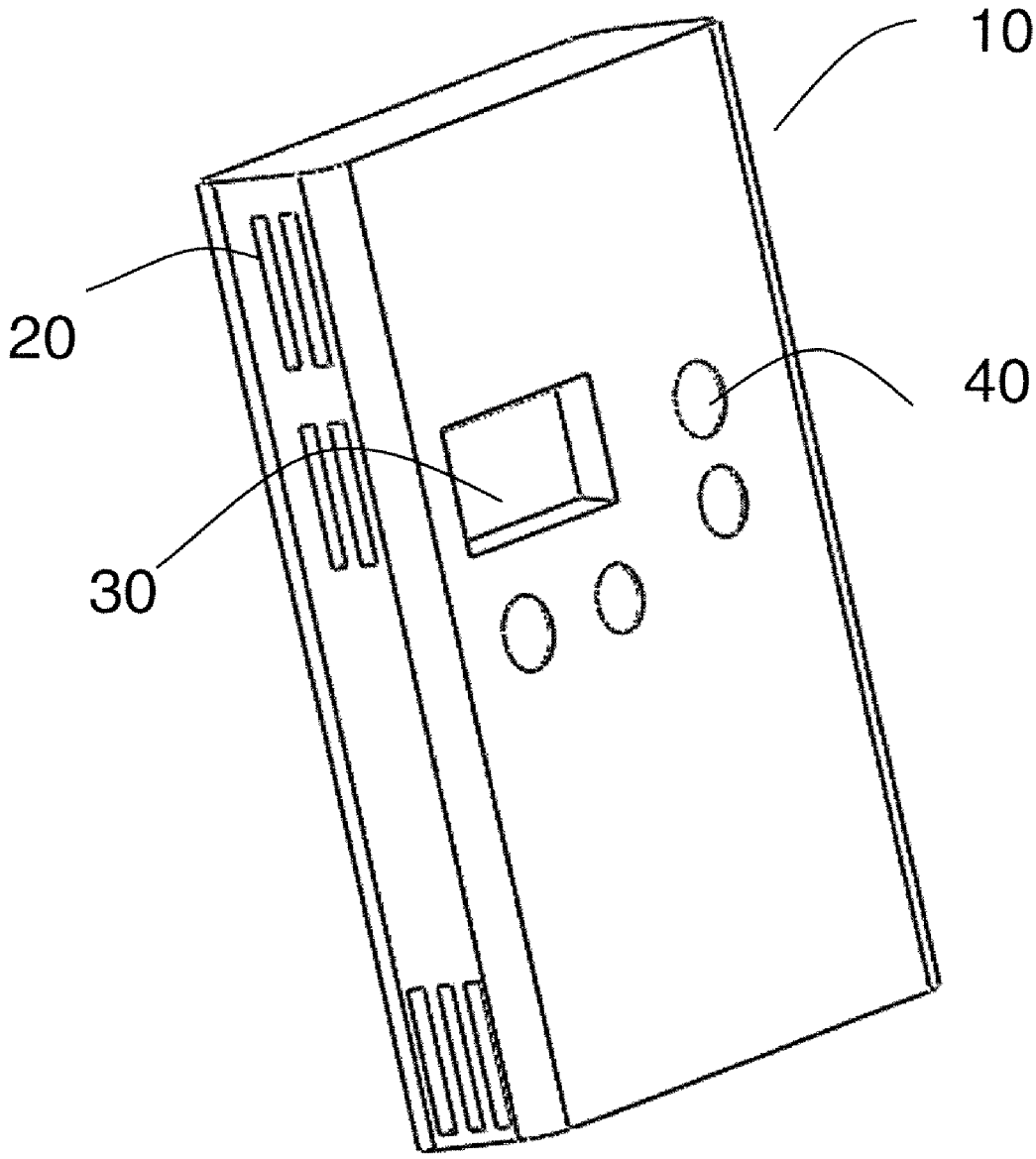
FIG. 1 is a front perspective view of an HVAC sensor with OLED display.
Figure 2:
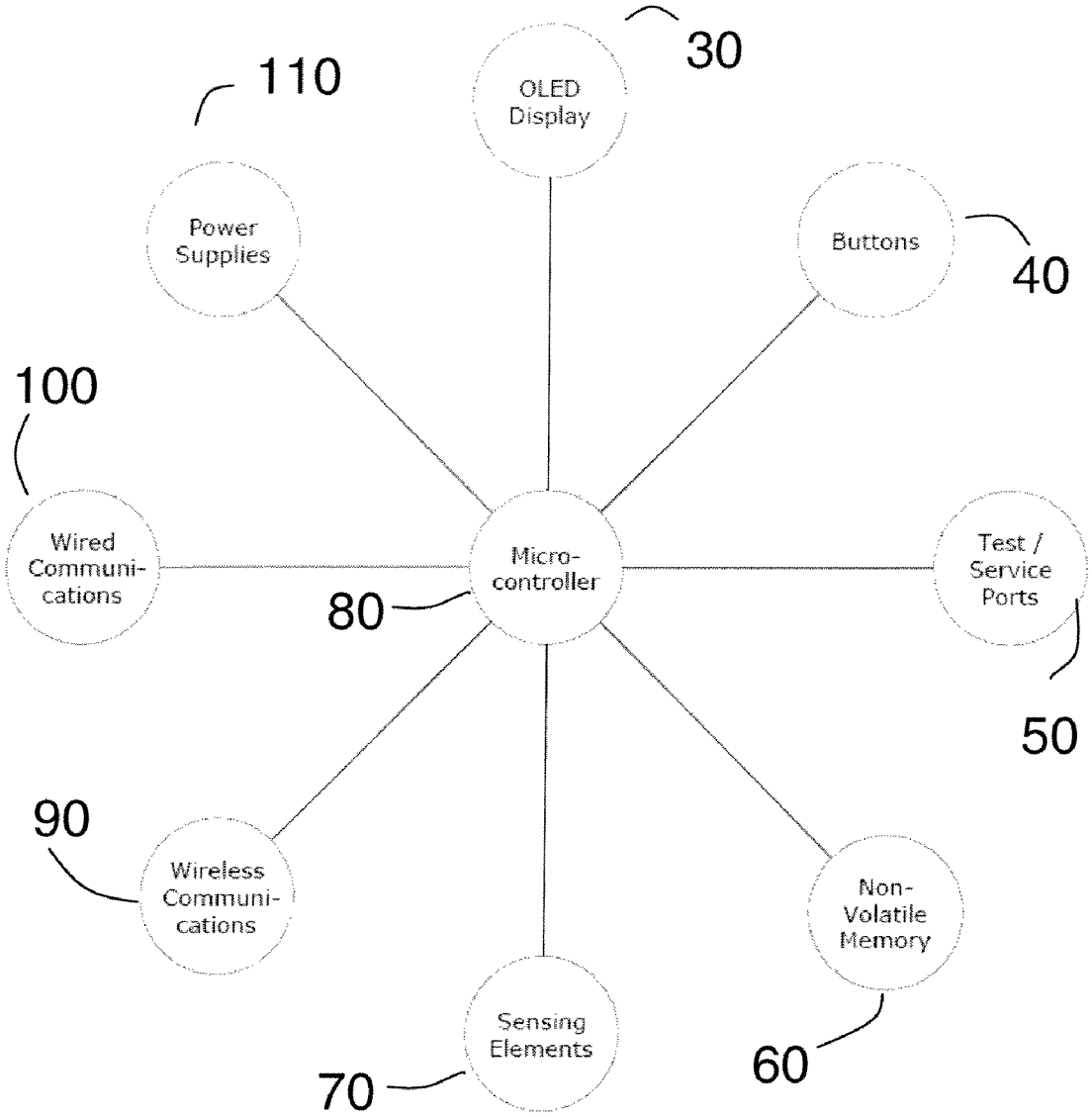
FIG. 2 is a block diagram of the HVAC sensor with all its components.

FIG. 1 shows an HVAC sensor or HVAC control unit enclosure 10 with ventilating air slots 20 surrounding the HVAC control unit enclosure 10 to allow ambient air flow through the HVAC control unit enclosure 10. HVAC control unit enclosure 10 also comprises an OLED display screen 30 for reading information that is transmitted to the HVAC control unit enclosure 10. The OLED display screen 30 is a 96×64 pixel display that is capable of graphics or text. Additionally, the dimension of the OLED display screen 30 across the diagonal is 1.0 inch. However, it should be noted that any resolution or size may be considered for the OLED display screen 30 depending on customer specification and needs and is not limited to the above and may be larger or smaller depending on use. It should also be noted that the OLED display screen 30 may have touch screen characteristics or use interactive graphics based on customer specification and needs. The OLED display screen 30 is of a monochrome yellow color because this preferred color promotes the longest life and lowest power color. A feature of the OLED display screen 30 is that it is emitting which means each pixel generates its own luminance, therefore no lamps are used. The microcontroller 80 (as seen in FIG. 2) will control the OLED display screen 30 through a digital communication. The OLED display screen 30 is powered when the HVAC control unit enclosure 10 is powered, although microcontroller 80 may have the ability to power it down. If the building loses power, so will the HVAC control unit enclosure 10; there is no battery or capacitive backup. The buttons 40 allow the users to interface with the HVAC control unit enclosure 10 to control various settings including the temperature set point.

FIG. 2 shows all components included in the HVAC control unit enclosure 10 As mentioned above, OLED display 30 is an organic light emitting diode display for reading information that is transmitted to the HVAC control unit enclosure 10. The OLED display 30 is a module, meaning it may be communicated via a serial or parallel digital communication to tell it what to display. Buttons 40 allow the users to interface with the HVAC control unit enclosure 10 to control various settings including the temperature set point. The testing service ports 50 are a variety of connectors. In one instance of an HVAC control unit enclosure 10, a laptop computer may be connected to the testing service port 50. In another example, in order to change the operating mode of the HVAC control unit enclosure 10, there is a custom "key" that may be connected to the testing service port 50. Connecting a computer or another tool into the testing service port 50 allows loading of custom data, images for the display, and calibration data for the HVAC control unit enclosure 10. Calibration data refers to information that is used to correct the output values of a building automation system, such as temperature, humidity, or any other environmental sensed value. An environmental sense valued may include a set point, an override, or fan speed. Similarly, testing service port 50 may also allow for easier manufacturing or design testing of the HVAC control unit enclosure 10. A non-volatile memory 60 is memory that does not get erased when the HVAC control unit enclosure 10 loses power. The non-volatile memory 60 is required to contain HVAC control unit enclosure 10 specific calibration data. Other information that may be loaded in the non-volatile memory 60 includes model specific information, such as whether or not the HVAC control unit enclosure 10 should display in degrees Fahrenheit or degrees Celsius, whether a certain sensed value should be displayed for that model, or the value of the set point step size. Sensing elements 70 are any number of analog or digital sensing devices that convert the air space temperature, humidity, or other conditions into an electrical signal. If an analog signal is created, the microcontroller 80 will need to convert that to a digital signal. If the sensing elements 70 are a digital integrated circuit or a MEMS device, it may communicate directly with the microcontroller 80 to relay the air condition. Wireless Communications 90 is a communications driver and radio to communicate wirelessly. A HVAC control unit enclosure 10 will typically have a wireless communication or a wired communication. Wired Communications 100 is another type of communications driver. An HVAC control unit enclosure 10 will typically have a wireless communication or a wired communication. Lastly, power supplies 110 is the section of the HVAC control unit enclosure 10 that uses all available power, for example, 24 VAC/VDC, 5 VDC, battery, other power that is used in the art and converts it into the required power for each component. The OLED display 30 in the present invention requires both 3.3V and 12V.

Figure 3:
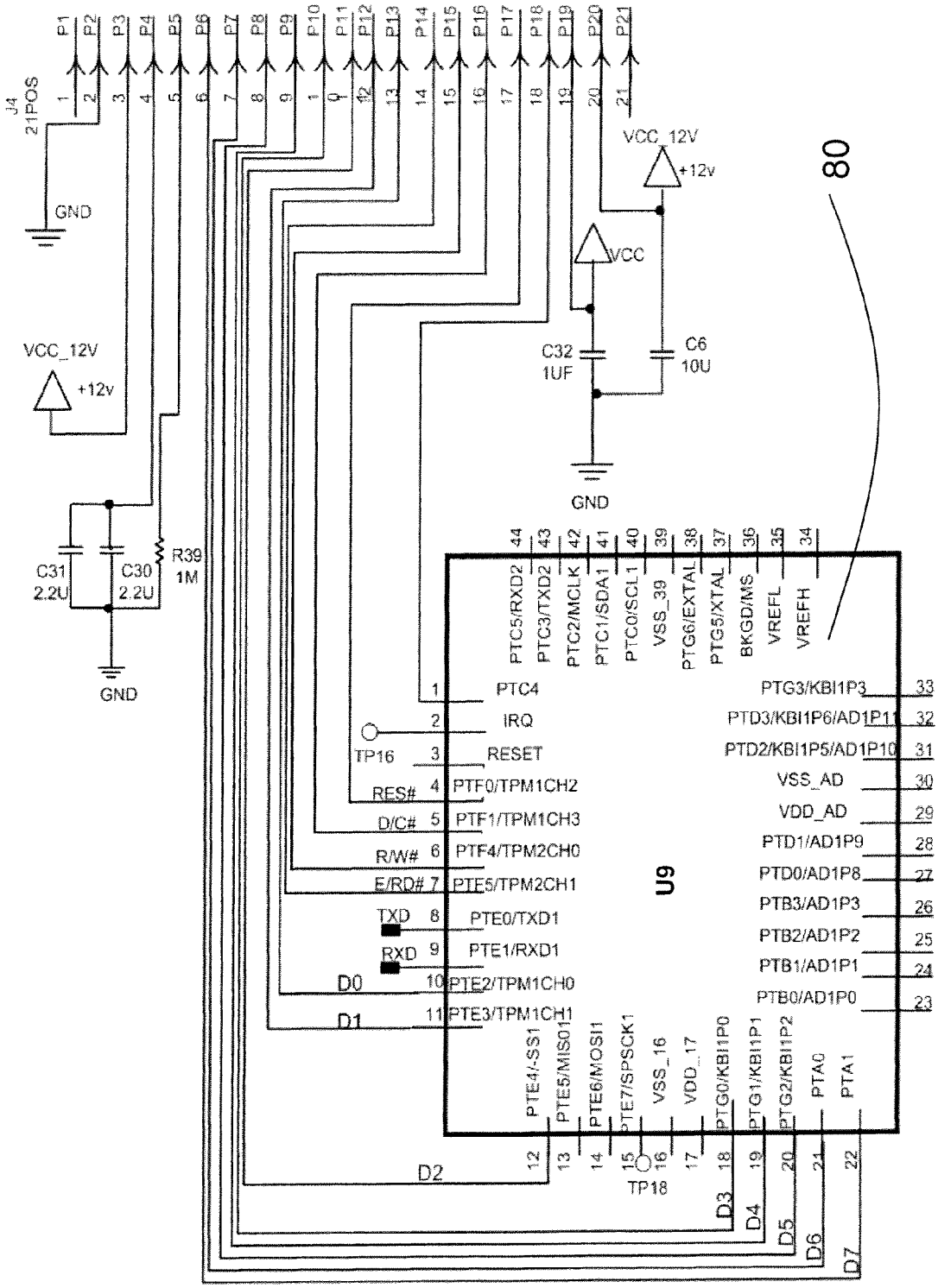
FIG. 3 is a circuit diagram of the HVAC sensor including the OLED display.

FIG. 3 shows the circuitry of the HVAC control unit enclosure 10. FIG. 3 shows a connector J4 into which the OLED display screen 30 may be connected. This could alternatively be where the OLED display screen 30 is soldered directly to the printed circuit board. Support capacitors and resistors are also shown for handling the electrical tolerances of the circuitry as is standard in the art. The control signals and data lines are wired to the microcontroller (U9) 80 for processing and then to provide the necessary output that will be transmitted to the OLED display screen 30. Firmware inside the microcontroller (U9) 80 informs the OLED display screen 30 what to do and also what to display.

While the foregoing description and drawings represent the preferred embodiments of the present invention, it will be apparent to those skilled in the art that various changes and modifications may be made therein without departing from the true spirit and scope of the present invention.

The invention claimed is:

1. A building control sensor system comprising:

a microcontroller configured to store and execute firmware instructions;

a MEMS sensing element coupled to the microcontroller, wherein the MEMS sensing element is configured to communicate at least one air condition to the microcontroller;

a self-emitting organic light-emitting diode (OLED) display coupled to the microcontroller, wherein the firmware instructions are programmed to control information displayed via the OLED display;

a set of cursor buttons coupled to the microcontroller, wherein the cursor buttons are configured to allow interaction with the firmware instructions executed by the microprocessor;

a testing service port coupled to the microcontroller, wherein the testing service port is configured to receive a custom key to change an operating mode of the executed firmware instructions;

a wired communication coupled to the microcontroller; and a power supply configured to supply power to the microcontroller, wherein the self-emitting OLED display is operable without a backlight.

2. The building control system of claim 1, wherein the OLED display screen further comprises a 96×64 pixel display.

3. The building control system of claim 1, wherein the OLED display screen displays a graphic.

4. The building control system of claim 1, wherein the OLED display screen displays a text.

5. The building control system of claim 1, wherein the OLED display screen has a diagonal dimension of 1.0 inch.

6. The building control system of claim 1, wherein the OLED display screen is a monochrome yellow color.

7. A display for a building control sensor system, comprising:

a printed circuit board having a plurality of data lines provided therein;

a microprocessor supported by the printed circuit board, wherein the microprocessor is configured to store and execute firmware instructions, and wherein a custom key is configured to change an operating mode of the executed firmware instructions;

an OLED module soldered directly to the printed circuit board and arranged in digital communication with the microprocessor, wherein the OLED module further comprises:

a self-emitting organic light-emitting diode (OLED) display configured to receive one or more control signals generated by the firmware executing on the microcontroller, wherein the control signals determine what is displayed, wherein the self-emitting OLED display is operable without a backlight.

8. The display for a building control sensor system of claim 7, wherein the OLED display screen comprises a 96×64 pixel display.

9. The display for a building control sensor system of claim 7, wherein the OLED display screen displays a graphic.

10. The display for a building control sensor system of claim 7, wherein the OLED display screen displays a text.

11. The display for a building control sensor system of claim 7, wherein the OLED display screen has a diagonal dimension of 1.0 inch.

12. The display for a building control sensor system of claim 7, wherein the OLED display screen is a monochrome yellow color.

13. A method to display information for a building control system, the method comprising:

providing a microcontroller, wherein the microcontroller is carried by a printed circuit board having a plurality of data lines;

coupling a MEMS sensing element to the microcontroller, wherein the MEMS sensing element is configured to communicate at least one air condition to the microcontroller;

providing a self-emitting organic light-emitting diode (OLED) display, wherein the OLED display is removably coupled to the printed circuit board via a connector and is in communication with the microcontroller;

receiving an input provided by at least one of a set of cursor buttons coupled to the microcontroller;

providing a testing service port coupled to the microcontroller, wherein the testing service port is configured to receive a custom key to change an operating mode;

providing a wired communication coupled to the microcontroller; and providing a power supply, wherein the self-emitting OLED display is operable without a backlight.

14. The method to display information for a building control system of claim 13, wherein the OLED display screen comprises a 96×64 pixel display.

15. The method to display information for a building control system of claim 13, wherein the OLED display screen displays a graphic.

16. The method to display information for a building control system of claim 13, wherein the OLED display screen displays a text.

17. The method to display information for a building control system of claim 13, wherein the OLED display screen has a diagonal dimension of 1.0 inch.

18. The method to display information for a building control system of claim 13, wherein the OLED display screen is a monochrome yellow color.

19. A method to display information for a building control system, the method comprising:

powering up a building controller having a microprocessor with a power supply;

coupling a sensor element to self-emitting organic light-emitting diode (OLED) display via the microprocessor, wherein the sensor element and the OLED display communicate with the microprocessor;

communicating a request for system information to the microprocessor;

transmitting the system information, in response to the received request, from the building controller to the microcontroller;

processing the system information by microcontroller;

receiving a custom key to change an operating mode of the microprocessor;

transmitting an output to the OLED display; and displaying the output on the OLED display, wherein the OLED display is configured to display the output whenever the building controller is powered by the power supply.

20. The building control system of claim 1, wherein the OLED display is configured to display information whenever the microcontroller is powered by the power supply.

* * * * *